US005117659A

United States Patent [19]

Sharp et al.

[11] Patent Number: 5,117,659

[45] Date of Patent: Jun. 2, 1992

[54] AUTOMATIC WASHER SUSPENSION SYSTEM

[75] Inventors: Brenner M. Sharp, St. Joseph Township, Berrien County, Mich.; Jeffrey L. Burk, Garze Garcia, Mexico; Robert A. Brenner, Leelanau Township, Leelanau County, Mich.

[73] Assignee: Whirlpool Corporation, Benton Harbor, Mich.

[21] Appl. No.: 635,776

[22] Filed: Dec. 28, 1990

[51] Int. Cl.[5] ..... D06F 37/24

[52] U.S. Cl. ..... 68/23.3; 248/613; 248/568; 248/638

[58] Field of Search ..... 68/23.3, 23.1; 248/568, 248/613, , 638, 570, 589, 565; 210/144; 267/140.1, 141.7, 134

[56] References Cited

U.S. PATENT DOCUMENTS

| | | | |
|---|---|---|---|
| 2,386,788 | 10/1945 | Geldhof et al. . | |
| 3,306,082 | 2/1967 | Hasegawa et al. . | |
| 3,348,796 | 10/1967 | Baratoff et al. . | |
| 3,373,961 | 3/1968 | Long . | |
| 3,703,091 | 11/1972 | Steele . | |
| 3,744,746 | 7/1973 | Weir et al. . | |
| 4,343,452 | 8/1982 | Bauer . | |
| 4,537,382 | 8/1985 | Beck . | |
| 4,625,529 | 12/1986 | Anderson . | |
| 4,991,412 | 2/1991 | Bauer et al. | 68/23.1 |

FOREIGN PATENT DOCUMENTS

| | | | |
|---|---|---|---|
| 52-55268 | 5/1977 | Japan | 248/613 |
| 60-8837 | 3/1985 | Japan | 68/23.3 |
| 62-122698 | 6/1987 | Japan | 68/23.3 |
| 2-92396 | 4/1990 | Japan | 68/23.3 |

*Primary Examiner*—Frankie L. Stinson

*Attorney, Agent, or Firm*—Hill, Van Santen, Steadman & Simpson

[57] ABSTRACT

An improved lower suspension ball or collet for a washing machine hung suspension system, the collet providing an axial channel for receiving a hung suspension rod therethrough, the collet supporting a portion of a floating base which holds the vibration inducing components, such as rotating washing machine components, the suspension rod attached at its top end to a frame such as a washing machine cabinet, the collet resiliently supported off of a bottom end of the suspension rod, the collet channel fashioned to act as a friction bushing in a spring-mass-damper arrangement. The collet comprises a tube portion having the axial channel which grips the rod to act as the friction bushing. The channel has an inside diameter smaller than an outside diameter of the rod. The tube portion provides two axially arranged slots cut therethrough offset by 90°. The slots being at opposite axial ends of the tube portion and terminate shy of the respective opposite axial end of the tube portion. The axially arranged slots provide sufficient flexibility or stretch to install the rod through the axial channel. A squeezing of the collet under axial load occurs during use, tending to open up the inside curvature of the tube portion channel to conform with the outside diameter of the rod.

26 Claims, 2 Drawing Sheets

AUTOMATIC WASHER SUSPENSION SYSTEM

BACKGROUND OF THE INVENTION

The present invention relates to a suspension system for an appliance, in particular, a method and apparatus to improve motion damping on a hung suspension system. The invention is particularly advantageous when used in an automatic washer.

A tub suspension system of the present invention includes a compact, easily assembled and reliable spring-mass-dampener system for suspending a floating base, on which a rotatable basket or clothes container of a clothes washing machine is mounted, supported from a cabinet in a manner to prevent vibration transference to the cabinet during normal operation of the machine and particularly as the basket is rapidly rotated during an extracting or centrifuging operation. Such a suspension system is disclosed in U.S. Pat. No. 3,744,746 to Weir et al., in U.S. Pat. No. 4,625,529 to Anderson and also in co-pending application Ser. No. 532,315.

The suspension system has a plurality of angularly spaced apart suspension assemblies interconnecting the tub floating base to the cabinet. Each of the assemblies comprises a rod with one end of each rod being resiliently connected by a coiled spring to the floating base. The coiled spring surrounds each hanger rod below the base, and transfers the weight of the base and components supported therefrom to the rod. Relative sliding movement of each rods in an axial direction is retarded or dampened by friction bushings, in this case a lower suspension ball or "collet" fitted over the rods above the spring and under the base, thereby to complete the spring-mass-dampener system.

The elimination of excessive vibrations in automatic washing, rinsing and drying machines for home use has been an area of continuing development. Excessive vibrations usually occur where there is a non-uniform distribution of clothes in a rotating clothes container or basket as the same spins rapidly to centrifuge excess water from the clothes. While a high rate of spin is desirable during the centrifuging operation, the maximum rate of spin is limited by the capabilities of the tub suspension system to isolate the machine cabinet from the vibrations or oscillatory motion caused by the unbalanced load. A complex suspension system may permit a high rate of spin, however, in order to maintain the cost of the laundry appliance within the reach of most consumers, the suspension system should also be compact, inexpensive and easily assembled.

Most state of the art hung suspension systems use a lower suspension ball that is partially split in half allowing it to grip the suspension rod at the ball's top end only. This system uses a lubricant (grease) between the rod and ball surfaces. The lubricant reduces ball wear and frictional noise. Therefore, frictional damping is limited by the small contact area of the ball to rod and the lubricant.

SUMMARY OF THE INVENTION

The present invention relates to a hung suspension system for an appliance, in particular, to an improved lower suspension ball or collet which acts as a friction bushing or dampener to the mass-spring-dampener arrangement of the hung suspension.

The lower suspension ball interfits into a domed shape lug, itself mounted to a floating suspension which supports the rotating or vibrating mass, such as the laundry tub of a washing machine. The suspension ball provides a channel therethrough which surrounds and grips a suspension rod. The suspension rod is mounted at an elevated end to the frame of the appliance, and at a lower end below the suspension ball the suspension rod holds an end cap. A spring is arranged between the end cap upwardly abutting the suspension ball. Because the suspension ball is at least partially split, the spring exerts a force in an axial direction on the ball, squeezes the suspension ball proportionally and influences the gripping force of the suspension ball which surrounds the suspension rod. Thus, because the gripping force against the rod is variable, the frictional force on the rod passing through the suspension ball is correspondingly varied. The net result of this phenomenon is that the suspension ball, as so designed, acts as a frictional damper to vibration and movement of the suspension rod moving axially reciprocally through the suspension ball.

The disclosed improved design uses a suspension ball that is substantially, but not fully, axially split in half in a first plane. The split occurring in an upper and central portion and leaving intact a lower end portion. The ball is also partially, but not fully, axially split in half in a second plane rotated 90° from the first plane. The split occurs in at least the lower portion and, preferably, also in the central portion. With the ball split in the described manner, there is improved frictional contact area between the full length of the ball and rod, therefore increasing the damping effect and wear surface.

The invention thus comprises two pairs of opposing slots that are oriented at 90° axially around the channel of the suspension ball. An inside diameter of the channel is sized smaller than an outside diameter of the rod. These slots allow the inside diameter of the channel to open up to conform to the rod. When the rod is assembled with the suspension ball, the channel expands resiliently to grip the diameter of the rod creating a residual clamping force in the suspension ball that exists independently of any externally applied loads.

These residual clamping forces encourage even, uniform, contact between the suspension rod and the suspension ball. This significantly increases the frictional forces created by the two cooperating parts.

Furthermore, by making the inside diameter of the channel smaller than the outside diameter of the rod, this dimensioning causes the suspension rod to initially be received into the channel causing slight opposing crescent-shaped gaps formed between the ball and the rod. These crescent-shaped gaps are formed because the channel does not open up completely to conform to the rod. Therefore, an edge contact between the rod and the ball results. However, when the ball is put under an axial load, i.e., compression of the spring, the ball is squeezed together, and the crescent-shaped gaps disappear as the squeezing of the ball causes the channel to conform more closely to the rod, i.e., to cause the inside diameter to open up further. This conforming of the channel inside diameter to the rod outside diameter creates a wear surface engagement between the rod and the ball that has intimate, uniform contact. If the channel inside diameter were designed to match the rod outside diameter in a relaxed state or an initial state, the rod would be able to twist back and forth in the ball, i.e., some play would exist, and some actual wear would need to take place before a stable and effective fit was created. This, however, would not occur until a significant part of the machine life had passed.

This invention creates an effective and easily manufactured suspension ball, with a long useful life, and also improves suspension performance by damping the excursion of the wash tub or oscillating mass when the mass accelerates through critical vibration speeds.

DETAILED DESCRIPTION OF THE PREFERRED EMBODIMENTS

Figure 1:
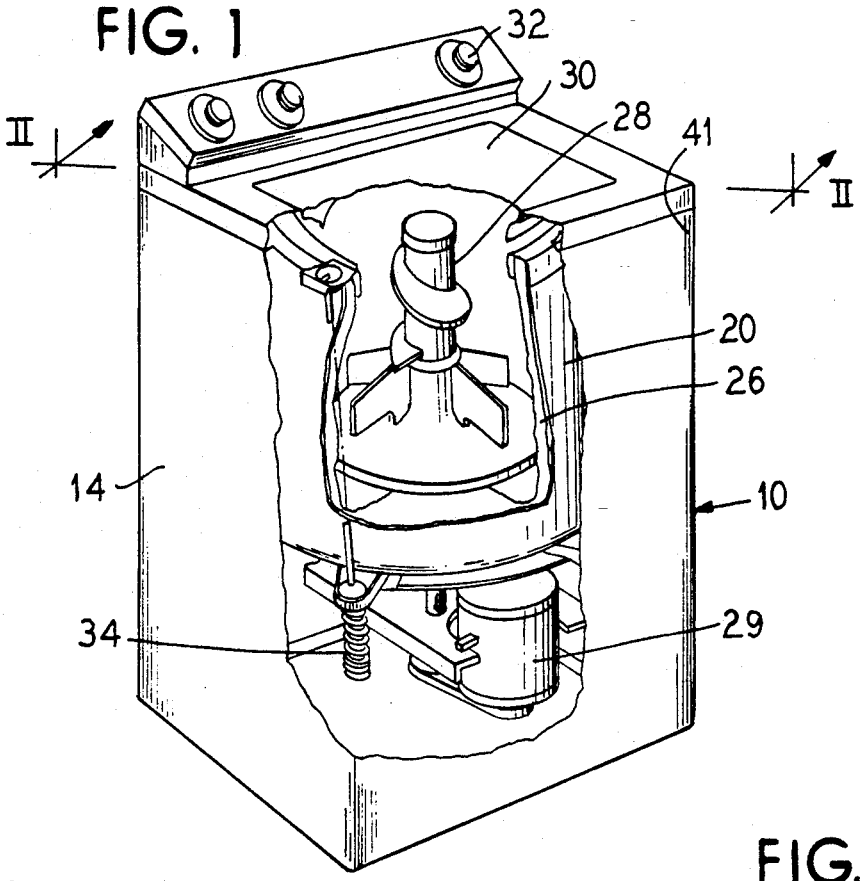
FIG. 1 is a fragmentary perspective view of a washing machine.

FIG. 1 shows a washing machine generally at 10 comprising a cabinet 14 holding therein a wash tub 20 which holds coaxially therein a clothes basket 26 having holes 27 for passing water. In the clothes basket 26 is mounted a vertical axis agitator 28. The clothes basket 26 and the agitator 28 are selectively driven by a electric motor arrangement 29 which includes the necessary transmission, belt drives, and controls as is known in the prior art. The washing machine has a door 30 for placing the clothes in the clothes basket as well as controls 32 for selecting wash parameters. The wash tub 20 is supported via a plurality of suspension strut assemblies 34 which hang the wash tub from the cabinet 14.

Figure 2:
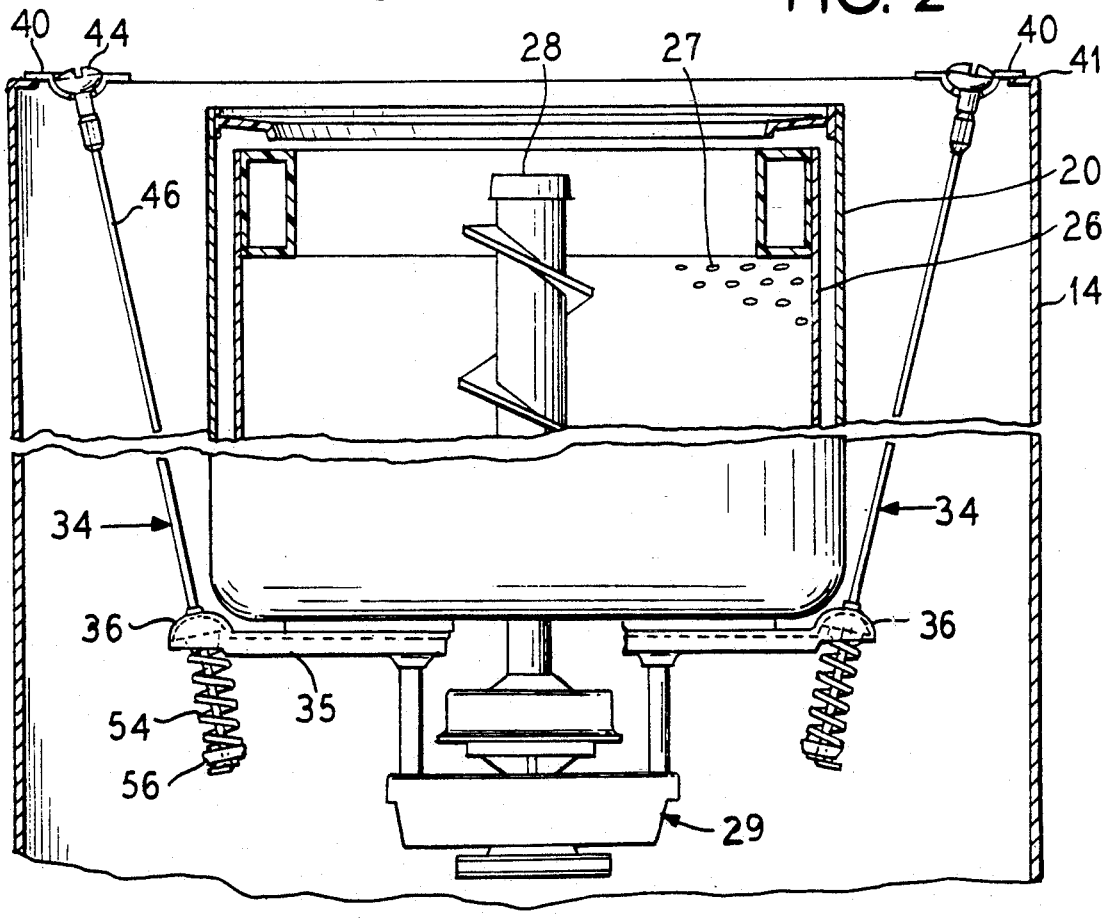
FIG. 2 is a partial sectional view of a washing machine taken generally along line II—II of FIG. 1.

FIG. 2 shows the wash tub 20 supported off a floating frame 35 which also supports the motor arrangement 29 hanging therefrom. The clothes basket 26 is supported from the wash tub 20 in a rotatable fashion (not shown). The floating frame 35 provides a plurality of sockets 36 extending outwardly of the wash tub 20 for engagement with the plurality of the suspension strut assemblies 34 to support the wash tub, motor assembly 29 and the clothes basket 26. Each suspension strut assembly 34 is supported by the cabinet 14 through the use of dished strut brackets 40, which can be positioned at each top corner 41 where the washing machine cabinet 14 is structurally strong.

The suspension strut assembly 34 comprises an upper ball support 44 which resides inside the dished strut bracket 40. The upper ball support 44 penetrates downwardly through a bottom hole **40*a* of each bracket 40 with an annular gap 45 surrounding a downward protruding portion 44*a* of the upper ball support. A rod 46 passes through the ball support 44 and proceeds downwardly through the socket 36 and terminates at an end cap 56. Between the end cap 56 and the socket 36 a suspension spring 54 is installed, relatively coaxially around the rod 46**.

Figure 3:
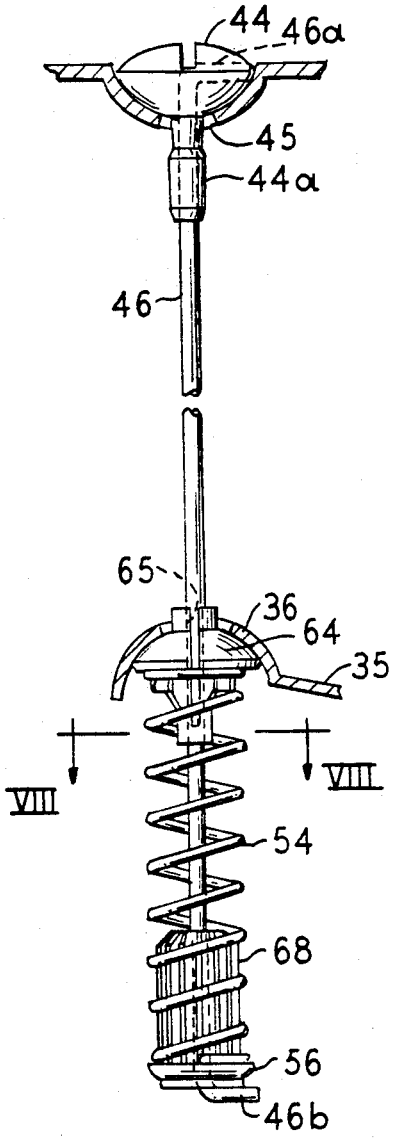
FIG. 3 is an enlarged elevational view of a suspension strut assembly of FIG. 2.

FIG. 3 shows the suspension strut assembly 34 in more detail. The suspension rod 46 has opposite turned ends **46*a*, 46*b* which prevent the upper ball support 44 and the end cap 56 from being removed from the suspension rod 46**.

The suspension rod 46 extends downwardly from the first turned end **46*a*, through the upper ball support 44, and to the socket 36. Inside the socket 36 resides a split suspension ball or collet 64 which embodies the present invention. The collet 64, which is a unitary molded member, provides an axial channel 65 which is axially transgressed by the suspension rod 46. The second turned end 46*b* holds the end cap 56 to the suspension rod 46 at the downward end of the suspension strut assembly 34. Between the collet 64 and the end ca 56 is arranged the suspension spring 54 which supports the collet 64 from the end cap 56 in a floating fashion. The collet 64 in turn supports the socket 36 which supports, along with all the suspension strut assemblies 34, the floating frame 35. Residing coaxially inside the suspension spring 54 and resting against the end cap 56 is a resilient end stop 68 which prevents hard bottoming out of the collet 64 against the end cap 56, i.e., the resilient end stop 68 provides a "bumper" against knocking or violent contact between the collet 64 and the end cap 56**.

Figure 4:
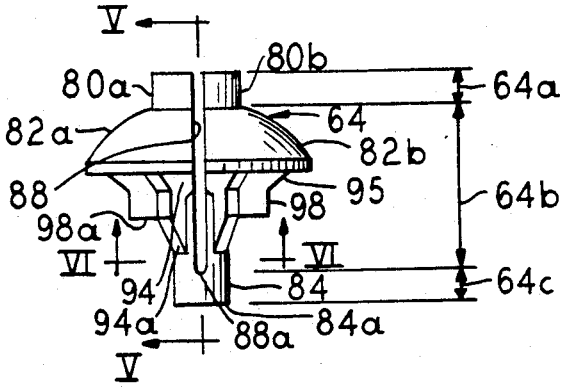
FIG. 4 is an enlarged elevational view of a split ball suspension piece shown in FIG. 3.
Figure 5:
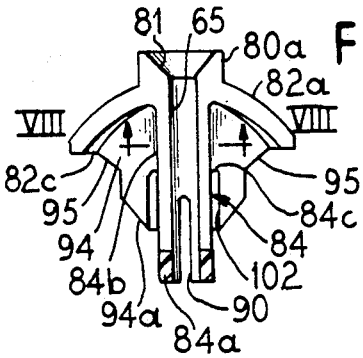
FIG. 5 is a sectional view of the split ball suspension piece viewed generally along line V—V of FIG. 5.

FIG. 4 shows an enlarged and isolated view of the collet 64. The collet 64 comprises left and right cooperating sleeve portions **80*a*, 80*b* at an upper portion 64*a*, and left and right cooperating spherically contoured shoulder portions 82*a*, 82*b* at a central portion 64*b* of the collet. The sleeve portions 80*a*, 80*b* are molded integrally with the shoulder portions 82*a*, 82*b*. The sleeve portions 80*a*, 80*b*, as more clearly shown in FIG. 5, are also molded integrally into a tube portion 84 which extends down to a lower portion 64*c* of the collet 64. A first planar slot 88 is formed in the collet 64 in the upper 64*a* and central 64*b* portions and separates the left sleeve portion 80*a* from the right sleeve portion 80*b* and forms a gap 89 between the left shoulder portion 82*a* and the right shoulder portion 82*b*. The first slot 88 proceeds downwardly through the tube portion 84 but terminates at a terminal end 88*a*, a short distance from a bottom end 84*a* of the tube portion 84. The slot 88 does not extend into the lower portion 64*c* of the collet 64**.

A plurality of formed webs 94 extend from an underside **82*c* of the left and right shoulder portions 82*a*, 82*b* to an outside surface 84*b* of the tube portion 84. A downwardly displayed finger 94*a* or a squared off finger 98, proceed from the webs 94 in generally parallel fashion to the tube portion 84. A slot-like clearance 102 is arranged between the fingers 94*a*, 98 and the outside surface 84*b* of the tube portion 84, shown clearly in FIG. 5. The webs 94 provide inclined surfaces 95, which are engaged by the suspension spring 54, permit axial force from the suspension spring to exert an inward squeezing force on the shoulder portions 82*a*, 82*b***.

FIG. 5 shows the cooperating sleeve portion **80*a* comprising a beveled peripheral inside diameter 81 at the top portion 64*a* which assists in assembly of the suspension rod 46 through the tube portion 84 as a funnel-like guideway to align the suspension rod 46 axially into the channel 65 of the tube portion 84**.

Figure 6:
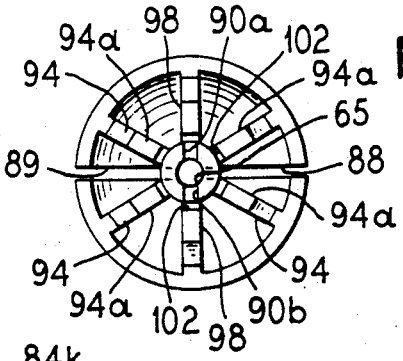
FIG. 6 is a sectional view of the split ball suspension piece viewed generally along line VI—VI of FIG. 4.

Arranged 90° offset around the axis of the tube portion 84 is a second slot 90 extending through the lower portion **64*c* and part of the central portion 64*b* of the tube portion 84. Since the tube portion 84 is a hollow tube, the slot 90 results in two slotted openings 90*a*, 90*b* through the tube portion 84, as shown in FIG. 6. The second slot 90 proceeds from the bottom end 84*a* upwardly to a terminal end 90c which is located above the terminal end 88a of the first slot 88. In the preferred embodiment the terminal end 90c is arranged somewhat below a lowest point of attachment 84c of the fingers 94a to the outside surface 84b of the tube portion 84**.

The squared off fingers 98 are aligned with a lateral axis aligning the slotted openings 90a, 90b of the second slot 90. The squared off fingers 98 terminate in flat surfaces 98a which provides for non-interference with tooling to form the second slot 90, the surface 98a being substantially aligned for clearance with the terminal end 90c of the second slot 90. The fingers 94a and the squared off fingers 98 are arranged to form around their outside circumference a physical perimeter to guide and hold therearound the suspension spring 54 centered onto the collet 64 and engaging the inclined surfaces 95.

Figure 8:
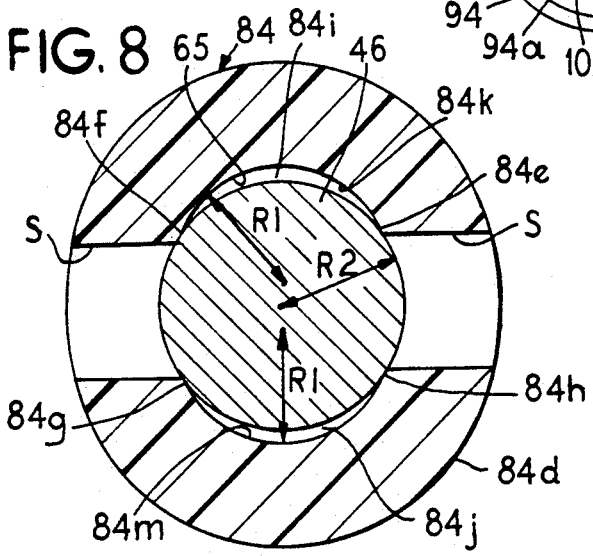
FIG. 8 is an enlarged sectional view taken generally along line VIII—VIII of FIG. 3 or VIII—VIII of FIG. 5.
Figure 7:
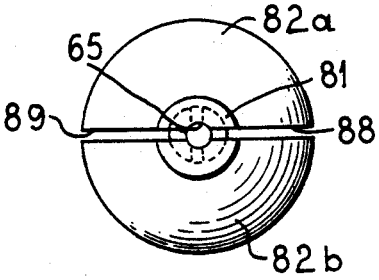
FIG. 7 is a plan view of the split ball suspension piece of FIG. 5.

As shown in FIG. 5 through FIG. 7, the channel 64 comprises a circular axial bore through the tube portion 84 and the cooperating sleeve portions 80a, 80b. Referring to FIG. 8, the channel 65, when the suspension rod 46 is pierced therethrough, is stretched to accommodate the suspension rod 46 which has a radius R2 greater than the radius R1 of the channel 65. The slot indicated at "S" is either the first slot 88 or the second slot 90 depending on location of the particular section of FIG. 8. When FIG. 8 is the section VIII—VIII as taken from FIG. 3 the slot S is the second slot 90. When FIG. 8 is the section VIII—VIII of FIG. 5, oriented 90° from the section of FIG. 3, the slot S is the first slot 88. Thus, the channel 65 is stretched or warped about two lateral axes of its circular cross section with the first slot 88 and the second slot 90 giving the tubular portion 84 the effective flexibility to do so.

The difference in radius dimensioning causes the suspension rod 46 to fit into the tube portion 84 with opposing crescent-shaped gaps 84i, 84j disposed between the suspension rod 46 and the tube portion 84c, 84d respectively. Therefore, an edge contact between the suspension rod 46 and the tube portion 84 occurs at edges 84e, 84f, 84g, 84h. When the collet is put under a load, i.e., compression of the suspension spring 54, the edges 84e, 84f, 84g, 84h spread and the gaps 84i, 84j disappear. This creates a wear surface engagement between the suspension rod 46 and the tube portions 84 that has uniform contact. If the radius R1 were designed to match the suspension rod radius R2 in a relaxed state, the rod would be able to twist back and forth in the collet 64 and wear would actually have to take place before a stable fit was created. This would not happen until a significant part of the machine life had passed.

Since the first slot 88 terminates at terminal end 88a short of the collet low end 84a, two web portions 85a, 85b which are interrupted by the second slot 90, are formed which bind the suspension rod into the collet and allow the collet to expand and contract evenly along its length as it wears against the suspension rod 46. Wear surfaces 84k, 84m along the length of the channel 65 are consistent, and are considerably larger than in a collet that has only one split or slot. The web portions 85a, 85b that connect the collet allow the collet 64 to flex but still provide enough strength to prevent the tube portion 84 from separating and being stripped from the suspension rod if the washing machine is mishandled during shipping or installation.

Wear surfaces 84k and 84m are self adjusting with wear. When a suspension load is applied to the machine, the suspension spring 54 bears against the inclined surfaces 95, forcing the two halves 82a, 82b together to conform into the socket 36 and thereby into intimate and even contact with the suspension rod. As the collet wears, these surfaces flex radially inward to maintain proper orientation and contact with the suspension rod 46. The first slot 88 is reduced evenly along its length as wear takes place. This invention results in a maximized wear surface of the tube portion and allows higher frictional damping forces to be generated.

Although the present invention has been described with reference to a specific embodiment, those of skill in the art will recognize that changes may be made thereto without departing from the scope and spirit of the invention as set forth in the appended claims.

The embodiments of the invention in which an exclusive property of privilege is claimed are defined as follows:

1. A friction bushing for damping reciprocal movement of a rod inserted therethrough with respect to a base portion engaged by said friction bushing, a means for biasing arranged to press said bushing against said base portion and to resist movement of said base and said bushing with respect to said rod in at least one axial direction, comprising:

a first inclined shoulder portion and a second inclined shoulder portion, facing toward each other in a spaced apart posture separated by a gap, said first shoulder portion providing a first surface facing said base portion and said second shoulder portion providing a second surface facing said base portion, and said base portion providing a third surface abutting said first and second surfaces, said first and second surfaces inclined toward each other such that force from said third surface upon said first and second surfaces squeezes said first shoulder portion and said second shoulder portion together;

a tube portion having an axial channel for insertion of said rod therethrough, said tube portion arranged between and connecting said first shoulder portion to said second shoulder portion at a first end of said tube portion, said tube portion split along its axis with a first slot, said first slot open to said gap, said first slot terminating at a first distance from a second end of said tube portion, said tube portion further split by a second slot from said second end of said tube portion toward said first end of said tube portion, said second slot oriented angularly offset about the axis of said tube portion from said first slot, said second slot terminating a second distance from said first end of said tube portion.

2. A friction bushing as claimed in claim 1 wherein said bushing further comprises:

a first web formed between an underside of said first shoulder portion, opposite said first surface, to an outside surface of and said tube portion; and a second web formed between an underside of said second shoulder portion, opposite said second surface, to said outside surface of said tube portion, said first and second webs providing oppositely inclined surfaces for abutting thereon said means for biasing, force from said means for biasing upon said oppositely inclined surfaces creating a force component acting to squeeze said first shoulder portion toward said second shoulder portion and acting to close said first slot to grip the rod held therethrough.

3. A friction bushing according to claim 2 wherein said means for biasing comprises a compression spring arranged coaxially with said rod said compression spring abutting said oppositely inclined surfaces of said first web and said second web, and said friction bushing further comprises at least two finger portions, each mounted to one of said webs and extending in a parallel direction as from said first end of said tube portion toward said second end, and arranged to fit inside said compression spring to axially align said compression spring to said friction bushing.

4. A friction bushing according to claim 1 wherein said axial channel has an inside diameter smaller than an outside diameter of said rod, said first slot and said second slot providing sufficient flexibility of said tube portion to insert said rod through said channel in a tight-fitting fashion.

5. A friction bushing according to claim 1 wherein said first surface of said first shoulder portion and said second surface of said second shoulder portion comprise together a spherically shaped surface, bisected by said gap, and said third surface of said base portion comprises a socket wherein said first shoulder portion and said second shoulder portion are snugly interfit therein.

6. A friction bushing according to claim 1 wherein said first slot terminates at a first point along the axis of said tube portion and said second slot terminates at a second point along the axis of said tube portion, said second point located between said first point and said first end of said tube portion along the axis of said tube portion.

7. A friction bushing according to claim 1, wherein said first slot is planarly aligned with said gap.

8. A friction bushing according to claim 1, wherein said second slot is oriented 90 offset about the axis of said tube portion from said first slot.

9. A suspension rod assembly for hanging a base from a frame arranged above the base, the base having base portions for engaging the assembly, comprising:

a rod mounted to said frame at a first end and terminating in a free second end located below the base;

a collet having:

a first inclined shoulder portion and a second inclined shoulder portion, facing toward each other in a spaced apart posture separated by a gap, said first shoulder portion providing a first surface facing said base portion, and said second should portion providing a second surface facing said base portion and said base portion providing a third surface abutting said first and second surfaces, said first and second surfaces inclined toward each other such that force from said third surface upon said first and second surfaces squeezes said first shoulder portion and said second shoulder portion together, said rod piercing said collet through said channel, said base portion overlying, and supported by said collet;

a tube portion having an axial channel for insertion of said rod therethrough, said tube portion arranged between and connecting said first shoulder portion to said second shoulder portion at a first end of said tube portion, said tube portion split along its axis with a first slot, said first slot open to said gap, said first slot terminating at a first distance from a second end of said tube portion, said tube portion further split by a second slot from said second end of said tube portion said first end of said tube portion, said second slot oriented angularly offset about the axis of said tube portion from said first slot, said second slot terminating a second distance from said first end of said tube portion;

an end cap mounted to said second free end of said rod; and a compression spring arranged coaxially around said rod, abutting at a first end said collet and at a second end said end cap, said compression spring biasing said collet away from said end cap.

10. An assembly according to claim 9, wherein said collet further comprises:

a first web formed between said first shoulder portion downwardly to said tube portion; and a second web formed between said second shoulder portion downwardly to said tube portion, said first and second webs providing inclined surfaces for abutting said compression spring, the force from said compression spring upon said inclined surfaces acting to squeeze said first shoulder portion toward said second shoulder portion and acting to close said first slot to cause the 12 tube portion to grip the rod held therethrough.

11. An assembly according to claim 10, wherein said collet further comprises at least two finger portions, each mounted to one of said webs and arranged to fit inside said compression spring to axially align said compression spring to said collet.

12. An assembly according to claim 9, wherein said axial channel has an inside diameter smaller than an outside diameter of said rod, said first slot and said second slot providing sufficient flexibility of said tube portion to insert said rod through said channel in a tight-fitting fashion.

13. An assembly according to claim 9, wherein said first surface of said first shoulder portion and said second surface of said second shoulder portion comprise a spherically shaped surface, bisected by said gap and said third surface o f said base portion comprises a socket wherein said first shoulder portion and said second shoulder portion are snugly interfit therein.

14. A friction bushing according to claim 9, wherein said first slot terminates at a first point along the axis of said tube portion and said second slot terminates at a second point along the axis of said tube portion, said second point located between said first point and said first end of said tube portion along the axis of said tube portion.

15. An assembly according to claim 9, wherein said first slot is planarly aligned with said gap.

16. An assembly according to claim 9, wherein said second slot is oriented 90° offset about the axis of said tube portion from said first slot.

17. A washing machine suspension strut assembly for hanging a floating base of a washing machine, said base holding the wash tub, clothes basket and motor assembly thereon, from upper portions of the washing machine cabinetry, comprising:

a rod mounted to said cabinet at a first end and terminating in a free second end located below the base;

a collet having:

a first inclined shoulder portion and a second inclined shoulder portion, facing toward each other in a spaced apart posture separated by a gap, said first shoulder portion providing a first surface facing said base portion and said second shoulder portion providing a second surface facing said base portion, and said base portion providing a third surface abutting said first and second surfaces, said first and second surfaces inclined toward each other such that force from said third surface upon said first and second surfaces squeezes said first shoulder portion and said second shoulder portion together, said rod piercing said collet through said channel, said base overlying, and supported by said collet;

a tube portion having an axial channel for insertion of said rod therethrough, arranged between and connecting said first shoulder portion to said second shoulder portion, at a first end of said tube portion, said tube portion split along its axis with a first slot, said first slot open to said gap, said first slot terminating at a first distance from a second end of said tube portion, said tube portion further split by a second slot from said second end of said tube portion toward said first end of said tube portion, said second slot oriented angularly offset about the axis of said tube portion from said first slot, said second slot terminating a second distance from said first end of said tube portion;

an end cap mounted to said free end of said rod;

a compression spring arranged coaxially around said rod, abutting at a first end said collet and at a second end said end cap said compression spring biasing said collet away from said end cap.

18. An assembly according to claim 17, wherein said collet further comprises:

a first web formed connecting said first shoulder portion downwardly to said tube portion; and a second web formed between said second shoulder portion down to said tube portion, said first and second webs providing oppositely inclined surfaces for abutting said compression spring, force from said compression spring upon said oppositely inclined surfaces acting to squeeze said first shoulder portion toward said second shoulder portion and acting to close said first slot causing the tube portion to grip the rod held therethrough.

19. An assembly according to claim 18, wherein said compression spring abuts said inclined surfaces of said first web and said second web, and said collet further comprises at least two finger portions each mounted to one of said webs and extending downwardly, and arranged to fit inside said compression spring to axially align said compression spring to said friction bushing.

20. An assembly according to claim 17, wherein said axial channel has an inside diameter smaller than an outside diameter of said rod, said first slot and said second slot providing sufficient flexibility of said channel to insert said rod through said channel in a tight-fitting fashion.

21. An assembly according to claim 17, wherein said first surface of said first shoulder portion and said second surface of said second shoulder portion comprise a spherically shaped surface, bisected by said gap, and said third surface of said base portion comprises a socket wherein said first shoulder portion and said second shoulder portion are snugly interfit therein.

22. An assembly according to claim 21, wherein said socket provides a hole wherein said tube portion protrudes toward said first en of said rod.

23. An assembly according to claim 17, wherein said first slot terminates at a first point along the axis of said tube portion and said second slot terminates at a second point along the axis of said tube portion, said second point located between said first point and said first end of said tube portion along the axis of said tube portion.

24. An assembly according to claim 23, wherein said second slot is laterally aligned with two oppositely arranged webs, and said second point is located between said second end of said tube portion and the juncture of said web with said tube portion.

25. An assembly according to claim 17, wherein said first slot is planarly aligned with said gap.

26. An assembly according to claim 17, wherein said second slot is oriented 90° offset about the axis of said tube portion from said first slot.

* * * * *